US009010590B2

(12) United States Patent
Kallenbach et al.

(10) Patent No.: US 9,010,590 B2
(45) Date of Patent: Apr. 21, 2015

(54) DISPENSING CLOSURE

(75) Inventors: Jason Kallenbach, Akron, OH (US); Phillip M. Rosegrant, Niceville, FL (US)

(73) Assignee: The J.M. Smucker Company, Orrville, OH (US)

( * ) Notice: Subject to any disclaimer, the term of this patent is extended or adjusted under 35 U.S.C. 154(b) by 0 days.

(21) Appl. No.: 13/377,455

(22) PCT Filed: Jun. 11, 2010

(86) PCT No.: PCT/US2010/038273

§ 371 (c)(1), (2), (4) Date: Dec. 9, 2011

(87) PCT Pub. No.: WO2010/144776

PCT Pub. Date: Dec. 16, 2010

(65) Prior Publication Data

US 2012/0074180 A1 Mar. 29, 2012

Related U.S. Application Data

(60) Provisional application No. 61/186,066, filed on Jun. 11, 2009.

(51) Int. Cl.

| | |
|---|---|
| ***B65D 47/12*** | (2006.01) |
| ***B65D 47/08*** | (2006.01) |
| ***B65D 47/06*** | (2006.01) |

(52) U.S. Cl.

CPC ..... *B65D 47/0804* (2013.01); *B65D 47/06* (2013.01)

(58) Field of Classification Search

CPC .... B65D 47/0804; B65D 47/06; B65D 41/02; B65D 25/48; B65D 47/12

USPC ..... 222/556, 567, 478–479, 571, 111, 546, 222/562, 568

See application file for complete search history.

(56) References Cited

U.S. PATENT DOCUMENTS

| | | | | | |
|---|---|---|---|---|---|
| 2,601,040 | A | * | 6/1952 | Gould | 222/109 |
| 2,731,053 | A | * | 1/1956 | Lockhart | 222/212 |
| 3,059,816 | A | * | 10/1962 | Goldstein | 222/109 |
| 3,168,221 | A | * | 2/1965 | Parker | 222/109 |
| 4,635,823 | A | * | 1/1987 | Stull | 222/108 |
| 5,097,992 | A | * | 3/1992 | Shiemann | 222/481.5 |

(Continued)

FOREIGN PATENT DOCUMENTS

EP 0912415 B1 8/2000

OTHER PUBLICATIONS

Office Action from CN Appln. No. 20108003683.4, Issued Nov. 30, 2012.

(Continued)

*Primary Examiner* — Kevin P Shaver
*Assistant Examiner* — Robert Nichols, II
(74) *Attorney, Agent, or Firm* — Calfee, Halter & Griswold LLP

(57) ABSTRACT

A closure includes a body having an outer skirt configured to be assembled with a container, a deck extending radially inward of the skirt, and a spout extending from the deck in a direction opposite the skirt. The spout surrounds a central portion of the deck that defines at least a first aperture having a front edge substantially flush with a front portion of the spout and a rear edge radially spaced from the rear portion of the spout by a portion of the deck.

27 Claims, 12 Drawing Sheets

(56) References Cited

U.S. PATENT DOCUMENTS

| | | | | |
|---|---|---|---|---|
| 5,377,882 | A * | 1/1995 | Pham et al. | 222/479 |
| 5,549,227 | A * | 8/1996 | Klotz | 222/461 |
| 5,579,957 | A * | 12/1996 | Gentile et al. | 222/153.14 |
| 5,642,824 | A | 7/1997 | Hess, III et al. | |
| 5,791,529 | A * | 8/1998 | Mukai | 222/478 |
| 6,138,877 | A * | 10/2000 | Goff | 222/479 |
| 6,230,937 | B1 | 5/2001 | Johnson et al. | |
| 6,257,431 | B1 | 7/2001 | Baudin | |
| 6,845,885 | B2 * | 1/2005 | Morgenroth | 222/109 |
| 6,935,543 | B2 | 8/2005 | DeGroot et al. | |
| 2003/0132247 | A1 | 7/2003 | Hsu et al. | |
| 2003/0209511 | A1 * | 11/2003 | Guyot | 215/253 |
| 2006/0091152 | A1 | 5/2006 | Evans et al. | |
| 2007/0194061 | A1 | 8/2007 | Rosegrant et al. | |
| 2009/0101646 | A1 * | 4/2009 | Paul et al. | 220/254.4 |
| 2013/0056501 | A1 * | 3/2013 | Beilke et al. | 222/478 |
| 2015/0048124 | A1 * | 2/2015 | Wisniewski | 222/478 |

OTHER PUBLICATIONS

International Preliminary Report on Patentability from International Application No. US2010/038273, issued Dec. 12, 2011.

Written Opinion from International Application No. PCT/US2010/038273, date of mailing Aug. 17, 2010.

International Search Report from International Application No. PCT/US2010/038273, date of mailing Aug. 17, 2010.

* cited by examiner

DISPENSING CLOSURE

CROSS-REFERENCE TO RELATED APPLICATION

This application claims priority to, and any other benefit of, U.S. Provisional Patent Application Ser. No. 61/186,066, entitled DISPENSING CLOSURE and filed Jun. 11, 2009, the entire disclosure of which is fully incorporated herein by reference.

BACKGROUND

Containers of pourable solid and/or liquid food products are commonly provided with a dispensing adapter (e.g., a spout, nozzle, or other such opening) to permit controlled passage of the food products (i.e., providing greater control than an open end of a bottle, jar, or other container). A cap or lid is typically provided for closing off the dispensing adapter to prevent unintentional spillage.

SUMMARY

The present application is directed to dispensing closures for use with a variety of pourable substances. The contemplated dispensing closures may, for example, include features configured to facilitate consistent and controllable pouring of a fluid, for example, a viscous fluid, such as a syrup product.

Accordingly, in one embodiment, an exemplary closure includes a body having an outer skirt configured to be assembled with a container, a deck extending radially inward of the skirt, and a spout extending from the deck in a direction opposite the skirt. The spout surrounds a central portion of the deck that defines at least a first aperture having a front edge substantially flush with a front portion of the spout and a rear edge radially spaced from the rear portion of the spout by a portion of the deck.

According to another inventive aspect of the present application, an exemplary closure includes a body and a cap. The body has an outer skirt configured to be assembled with a container and a deck extending radially inward of the skirt. The deck defines a first aperture and second and third apertures spaced apart from the first aperture, with the second and third apertures each being substantially smaller than the first aperture. The cap is moveable between a closed position covering the first, second, and third apertures and an open position uncovering the first, second, and third apertures.

DESCRIPTION

The present application contemplates dispensing closures for controlled passage of a contained pourable substance. According to an inventive aspect of the present application, a dispensing closure may be configured for consistent and controllable pouring of a viscous fluid, such as, for example, a syrup product. While the present application describes exemplary embodiments for use in dispensing a pancake syrup product, it is to be understood that many of the inventive features of the present application may be utilized for dispensing other types of pourable solid and/or liquid substances, including, for example, other toppings, coffee creamers, other coffee lighteners or flavorings, oils, condiments, seasonings, fertilizer, birdseed, sugar, and sauces, as well as pourable dairy products, pourable fruits and fruit juice products, and for jams, jellies and preserves.

According to an inventive aspect of the present application, a dispensing closure may be provided with a central deck defining at least one dispensing aperture, and a spout extending from the deck and at least partially surrounding the aperture. In one such embodiment, a dispensing aperture may have an edge that is spaced from the spout by a portion of the deck, such that the dispensing aperture is smaller than an inner perimeter of the spout. A reduced size dispensing aperture within the spout may help prevent excessive passage of fluid through the dispensing closure, while the larger spout (i.e., larger relative to the dispensing aperture) may facilitate containment of fluid not fully dispensed (i.e., remaining on the deck). As another example, a larger spout may be sized to surround both a dispensing aperture and at least one vent aperture in a central deck.

Figure 7:
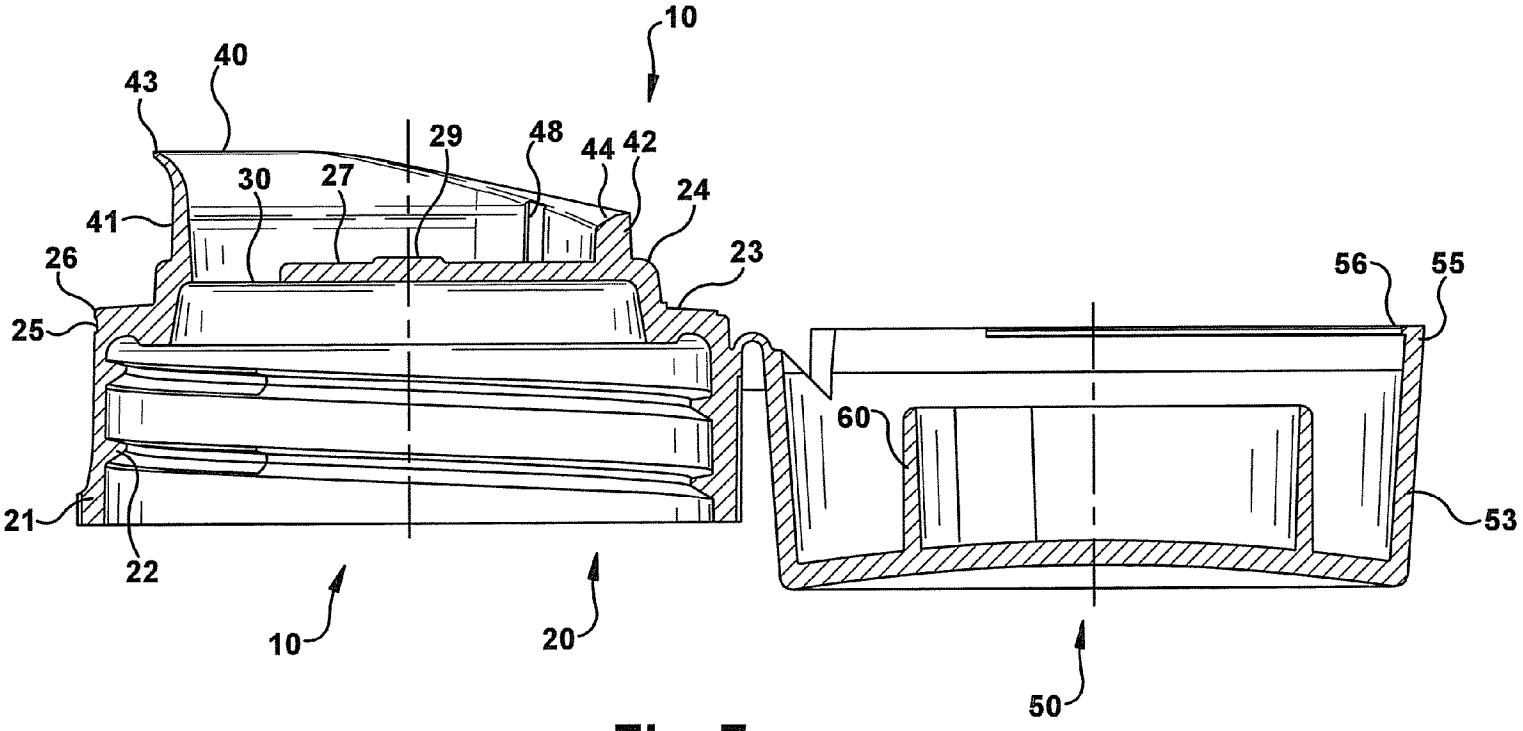
FIG. 7 is a side cross-sectional view of the dispensing closure of FIG. 1.
Figure 8:
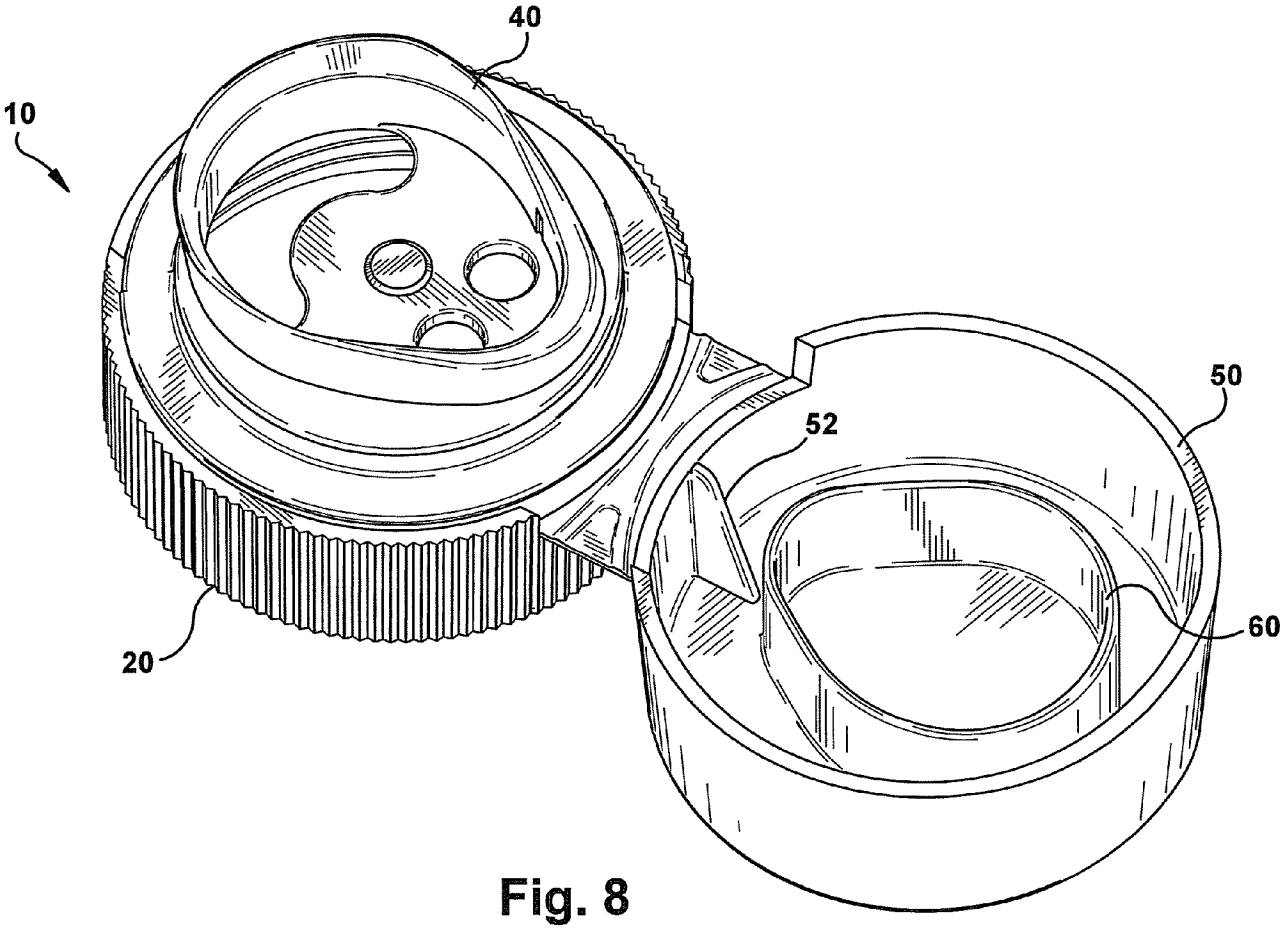
FIG. 8 is another upper perspective view of the dispensing closure of FIG. 1.
Figure 13:
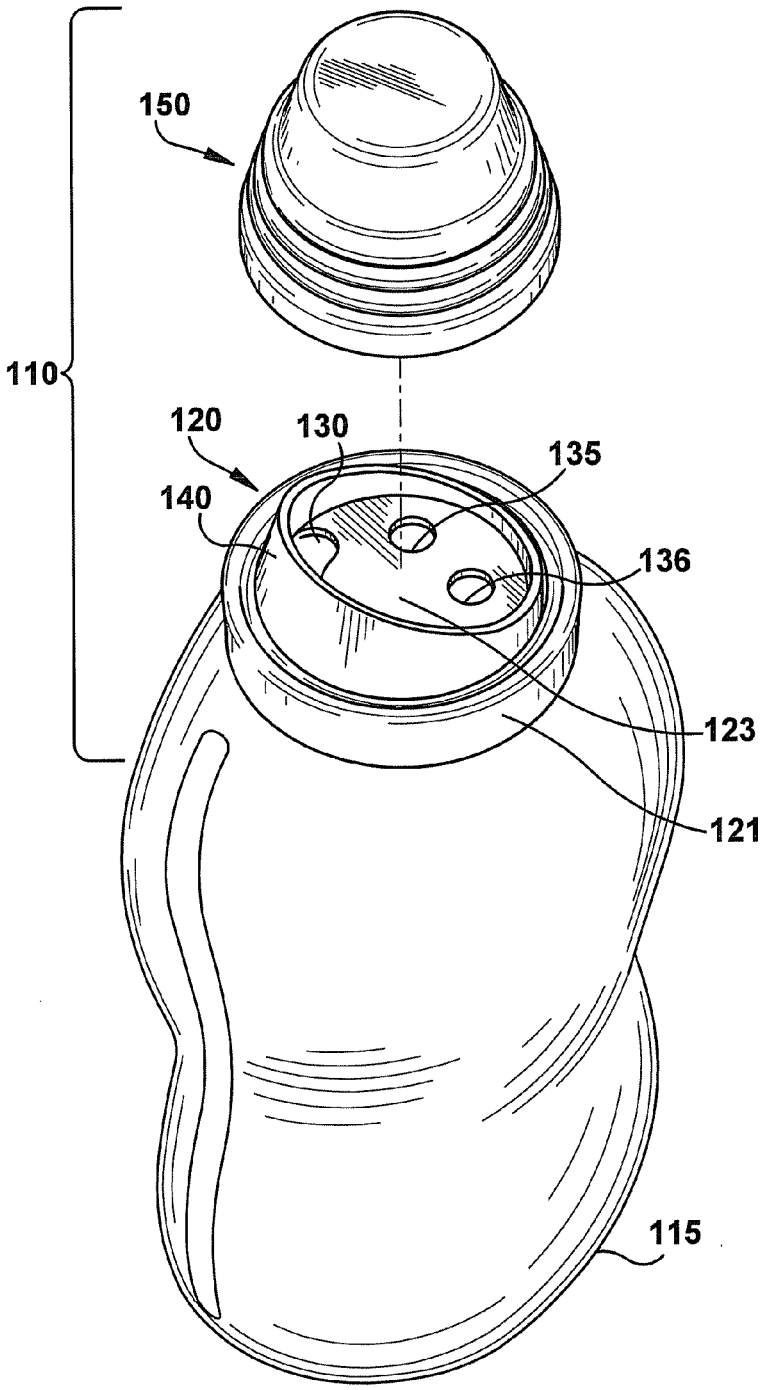
FIG. 13 is a perspective view of another exemplary dispensing closure shown assembled with a container.
Figure 15:
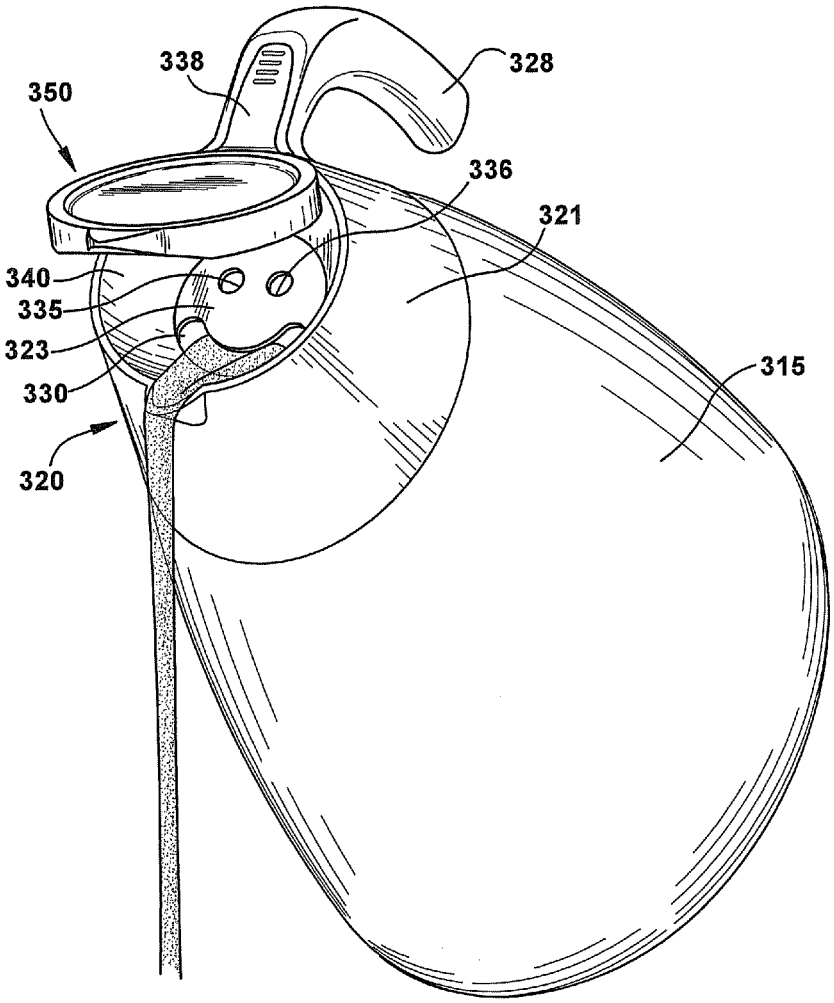
FIG. 15 is a perspective view of yet another dispensing closure shown assembled with a container.

FIGS. 1-9B illustrate various views of an exemplary embodiment of a dispensing closure 10. The closure includes a body portion 20 having an outer skirt 21 for assembly with a bottle or container 15 (shown, for example, in FIGS. 9A and 9B), and a deck portion 23 extending radially inward of the skirt 21. In the embodiment of FIGS. 1-9B, the deck portion extends radially inward from an upper end of the skirt 21. In other embodiments, (for example, the cap dispenser 310 of FIG. 15, described in greater detail below), the deck portion may be radially spaced from the skirt, and/or may be disposed between the upper and lower ends of the skirt. The skirt may include internal threads 22, as shown in FIG. 7, for threaded assembly with a container. Other assembly mechanisms, such as, for example, snap fit or interference fit (not shown), may also be utilized. The deck portion defines at least one dispensing aperture 30, and one or more vent apertures 35, 36 (described in greater detail below). The deck 23 may, but need not, include a raised portion 24 in which the dispensing aperture 30 is disposed. A cap 50 is provided for covering the dispensing aperture 23 to block flow from the aperture when the cap 50 is in a closed position (not shown) with respect to the body 20. In the embodiment of FIGS. 1-9B, the cap 50 is hingedly connected to (e.g., by hinge portion 51), and integral with, the body 20 at the outer skirt 21 for pivoting between a closed or covering position and an open or uncovering position. Any suitable hinging arrangement between the body 20 and the cap 50 may be utilized. One example of a hinging arrangement for a dispensing closure is described in U.S. Pat. No. 5,642,824, the entire disclosure of which is incorporated herein by reference. Additionally, as more clearly shown in FIG. 8, a support rib 52 or some other reinforcing structure may be provided in the cap 50, for example, to strengthen the hinged portion of the cap. In other embodiments, as shown, for example, in FIG. 13, the cap 150 may be separate from the body 120, such that the cap may be attached to the body (e.g., by a snap-fit engagement) in a closed position, and removed from the body in an open position.

The exemplary cap 50 includes an outer wall 53 that aligns with the outer skirt 21 when the cap 50 is in the closed position. The exemplary body 20 includes a recessed shoulder 25 sized to receive an edge 55 of the outer wall 53. While any suitable type of retaining engagement may be provided between the body and cap when the cap is in the closed position, in the illustrated example, a rim of the outer wall 53 includes an inward projecting rib 56 that interlocks with an outward projecting rib 26 on the recessed shoulder 25 of the body 20, to provide a snap-fit engagement between the body 20 and cap 50. This type of closing engagement is also shown in U.S. Pat. No. 6,935,543, the entire disclosure of which is incorporated herein by reference.

Figure 14:
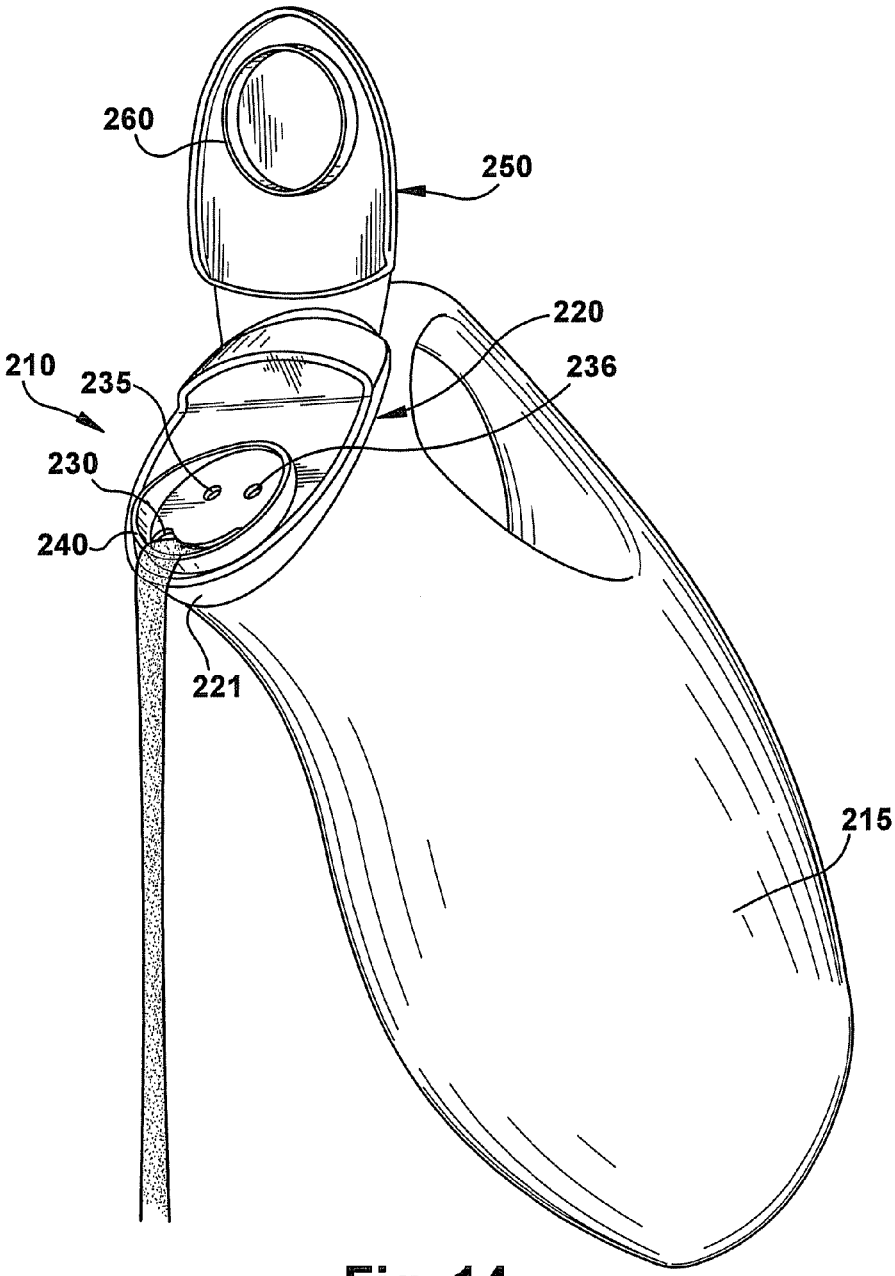
FIG. 14 is a perspective view of still another dispensing closure shown assembled with a container.

In the exemplary embodiment, a spout portion 40 extends upward from the deck 23 to at least partially surround a central portion 27 of the deck 23 and the dispensing aperture 30. The spout 40 may be angled or contoured at an angle from perpendicular to the desk 23, for example, to better direct or control dispensing flow, or to minimizing dripping onto the dispenser or container. In the illustrated example, the spout 40 includes a full perimeter having a first or front portion 41 proximate to the dispensing aperture 30 and a second or rear portion 42 proximate to the hinge 51. To prevent excessive pouring of the contents of the container, the apertures (e.g., dispensing aperture and vent apertures) may be substantially smaller than an inner perimeter of the spout, such that the central portion 27 of the deck 23 helps regulate or limit flow. In one embodiment, the apertures account for less than half of the total radially extending area within the spout (e.g., between 25% and 50% of the total area within the spout, or approximately 33% of the total area within the spout). While the spout 40 may be provided in many different shapes and sizes, in the illustrated embodiment, the front portion 41 of the spout 40 is an arcuate portion having a first radius, and the rear portion 42 of the spout is an arcuate portion having a second radius smaller than the first radius, such that the spout 40 forms a teardrop shape from a top view. Other shaped spouts may be provided, including, for example, circular (as shown, for example, in FIGS. 13 and 14) and elliptical spouts, as well as spouts having non-arcuate portions.

To facilitate consistent pouring, one or more vent apertures may be provided separate from the dispensing aperture in the deck portion of the dispensing closure, to allow air intake into the container as the contained fluid is being dispensed through the dispensing aperture, thereby preventing erratic spurting of the dispensing fluid during pouring. In one embodiment, a vent aperture may be positioned proximate to a hinge portion of the closure, such that the vent aperture is not obstructed by the dispensing fluid when the container is tilted for pouring. While the vent aperture may be provided in any suitable size, in one embodiment, the vent aperture is substantially smaller than the dispensing aperture, yet large enough for sufficient air intake.

Figure 9B:
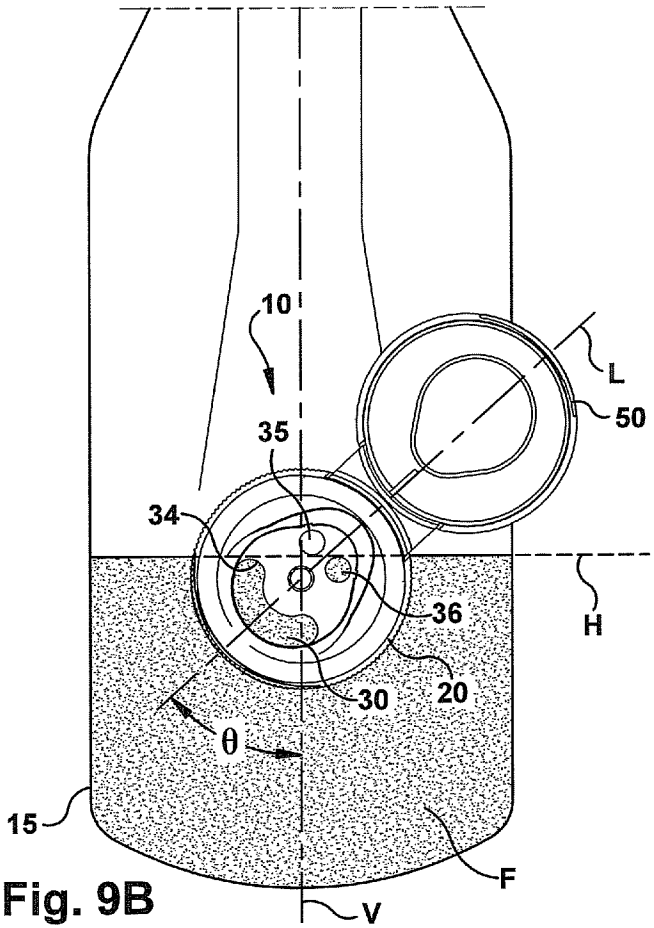
FIG. 9B is a top plan view of the dispensing closure of FIG. 1 shown assembled with a container in an off-center rotational position, with the container being in a pouring orientation.
Figure 9A:
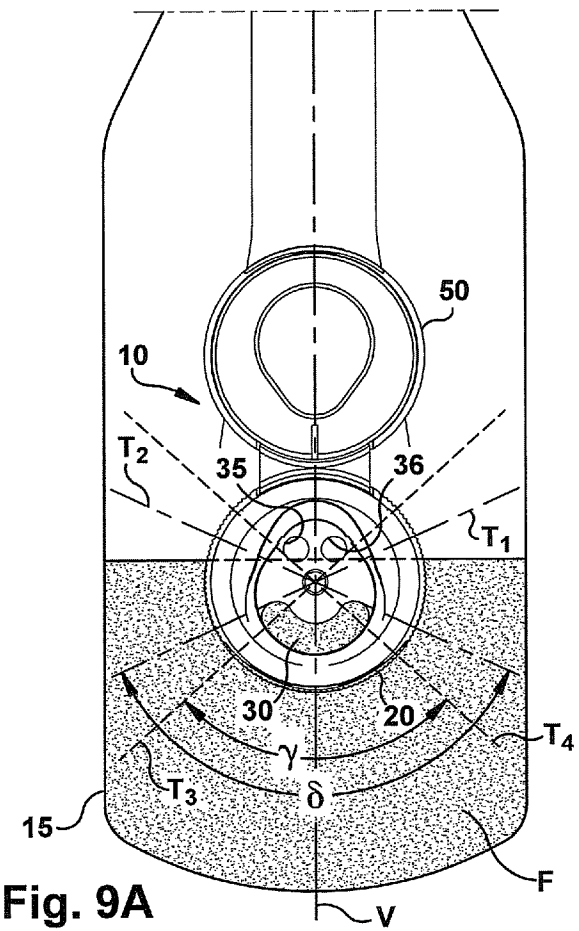
FIG. 9A is a top plan view of the dispensing closure of FIG. 1 shown assembled with a container in a centered rotational position, with the container being in a pouring orientation.
Figure 9D:
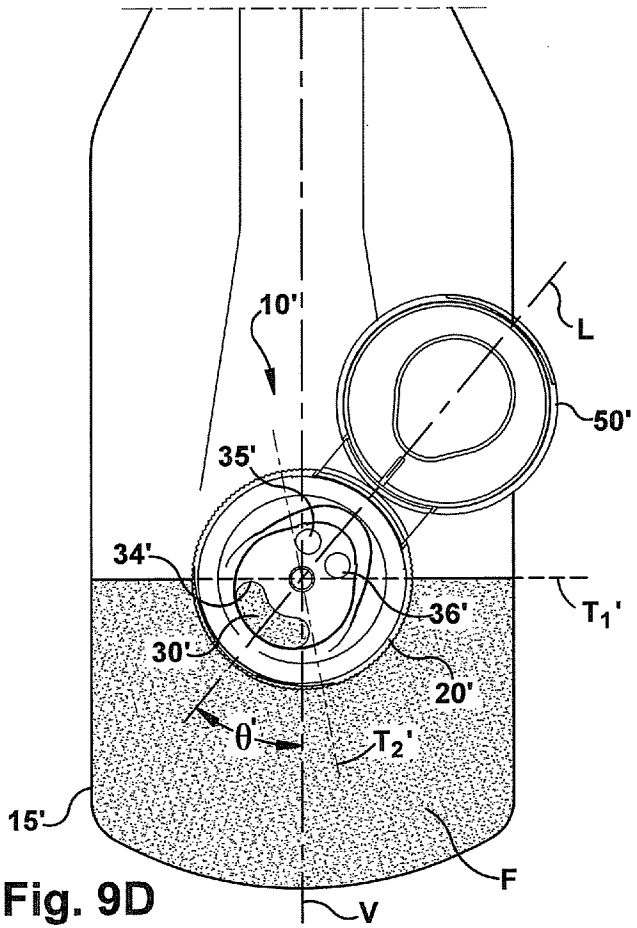
FIG. 9D is a top plan view of the dispensing closure of FIG. 1 shown assembled with a container in an off-center rotational position, with the container being in a pouring orientation.
Figure 9C:
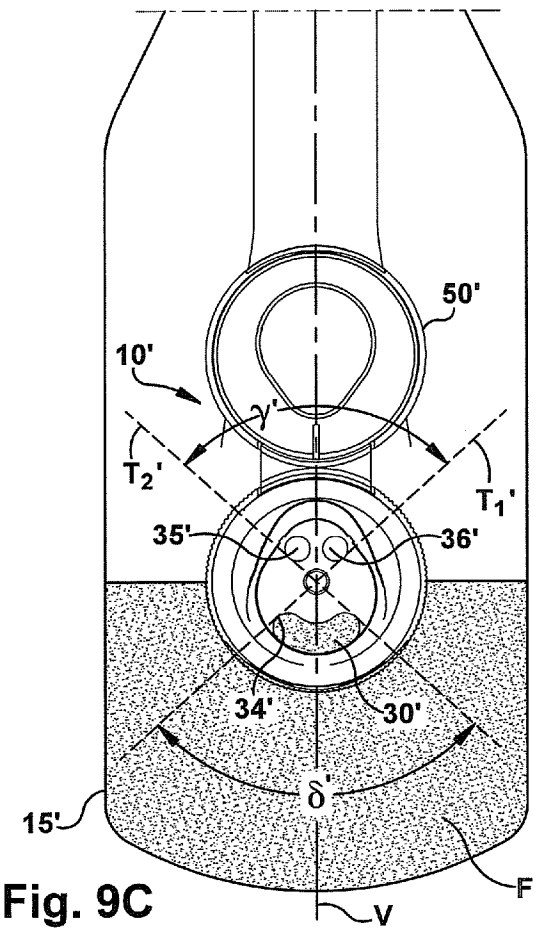
FIG. 9C is a top plan view of another exemplary dispensing closure shown assembled with a container in a centered rotational position, with the container being in a pouring orientation.
Figure 10:
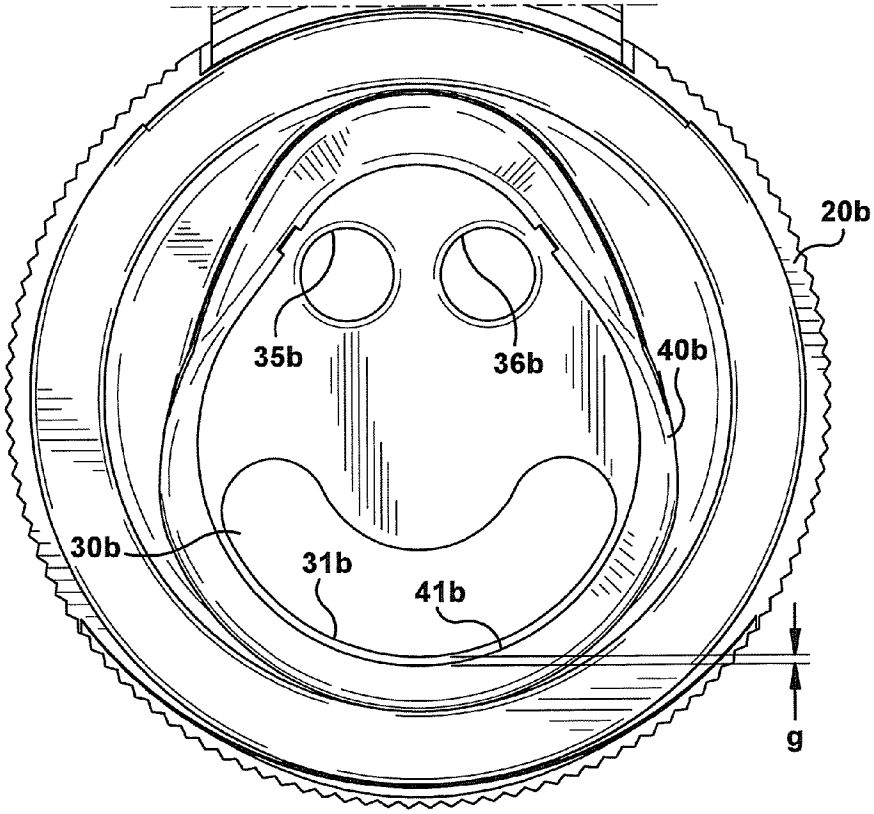
FIG. 10 is a top plan view of a dispensing aperture arrangement for a dispensing closure.
Figure 12:
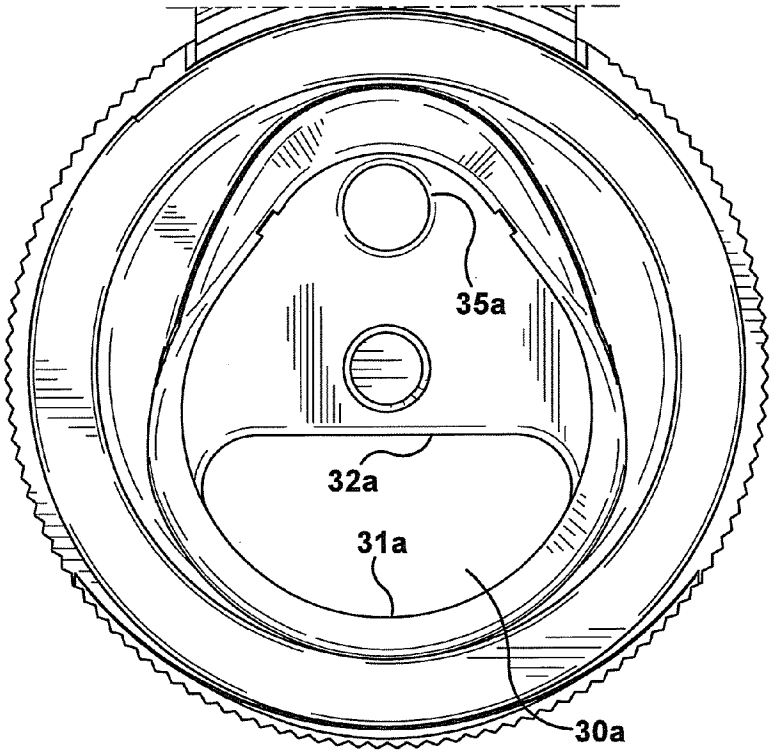
FIG. 12 is a top plan view of still another dispensing aperture arrangement for a dispensing closure.
Figure 11:
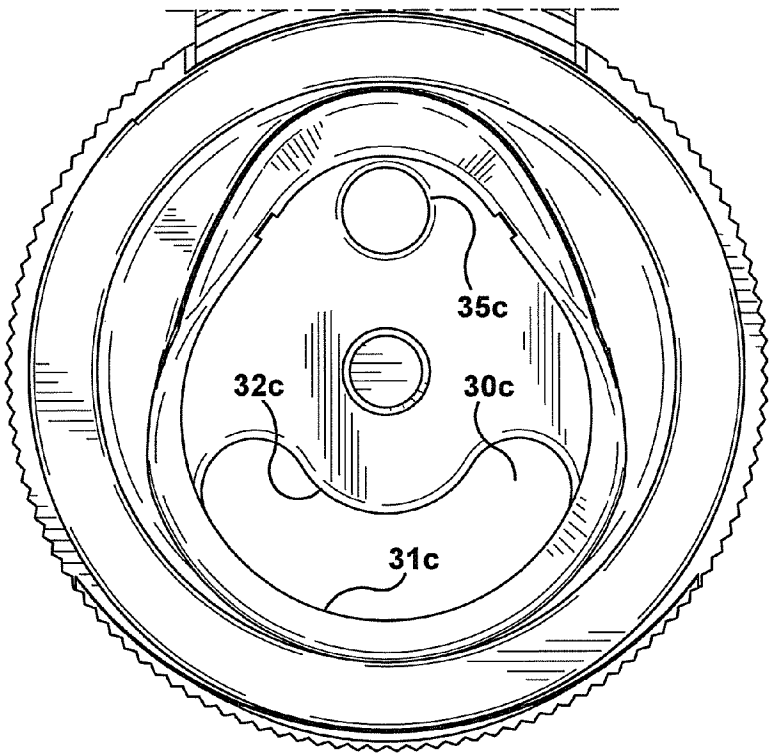
FIG. 11 is a top plan view of another dispensing aperture arrangement for a dispensing closure.

While a single vent aperture 35*a*, 35*c* may be utilized (as shown in FIGS. 11 and 12), multiple vent apertures 35, 36 may be provided (as shown, for example, in the embodiments of FIGS. 1-10). Other embodiments may use three or more vent apertures of varying sizes and locations.

To facilitate containment of any undispensed fluid, an inner surface of the cap 50 may be provided with a projection 60 sized and positioned for fluid-tight sealing engagement with the spout, for example, to prevent fluid from collecting between the spout 40 and the outer wall 53 of the cap 50. While a projection may be positioned to surround a spout for sealing engagement with an outer surface of the spout upon closure of the cap (not shown), in another embodiment, the projection may be received in the spout upon closure of the cap for sealing engagement with an inner surface of the spout. Such a projection may be formed, for example, as a solid plug or a circumferential wall or flange shaped to match the inner surface of the spout. In the illustrated embodiment, the cap 50 includes a circumferential flange projection 60 extending from an inner surface to be received within the spout 40 when the cap 50 is in the closed position.

To facilitate alignment of the projection 60 with the spout 40 during closure of the cap 50, the rear portion 42 of the spout 40 may be provided with a thickened portion having an inwardly declining upper chamfered surface 44 that guides a rear edge of the projection 60 into the spout 40 during closure. Likewise, an outward contoured lip on a front portion of the spout (described in greater detail below) may also serve to guide the projection 60 into the spout 40 during closure. Alternatively, a similar chamfered guide surface may be provided on an outer surface of the projection (not shown) to facilitate closure. Additionally or alternatively, as shown, the rear portion 42 of the spout 40 may be sloped downward (i.e., gradually shorter towards the hinge) to reduce interference between the spout 40 and the projection 60 during closure.

To prevent overpressurization of the fluid-sealed central cavity (defined by the central portion 27 of the deck 23, spout 40, projection 60, and cap inner surface), one or more vent passages or grooves 48 may be provided to allow pressurized air (e.g., when the closed container is heated) to escape from the central cavity. The vent passages 48 may be small enough to substantially prevent passage of the contained fluid (e.g., to prevent leakage or dripping). The vent passages 48 may be provided, for example, in an inner surface of the spout (as shown in the illustrated embodiment), on an outer surface of the projection, or through the top of the cap. In one embodiment, the vent grooves 48 may be provided with a 0.015" radius on its edges.

To facilitate drainage of undispensed fluid on the central deck portion 27 back into the container, and to minimize entrapment of fluid between the projection 60 and the central deck portion 27 upon closure, the front edge 31 of the dispensing aperture 30 may be flush with the inner surface of the spout front portion 41. In other embodiments, as shown in FIG. 10, a small ledge or gap g (e.g., 0.020") may be provided between the front portion 41*b* of the spout 40*b* and the front edge 31*b* of the dispensing aperture 30*b*.

According to an inventive aspect of the present application, a dispensing closure may be configured to accommodate consistent pouring of a fluid over a range of dispensing aperture orientations. As one example, a cocked or rotated position of the dispensing aperture 30 may result from the dispensing closure 10 being "off-center" on the container 15, which may result, for example, from varied threaded engagement between the closure 10 and the container 15. This off-center position may be measured as an angle θ between a lateral centerline L of the dispensing aperture 30 and a vertical plane V extending perpendicular to a horizontal pour axis H about which the associated container 15 is tilted to pour the contained fluid F (see FIG. 9B). Where the container 15 is provided with a handle or narrow cross-section (e.g., for ease of gripping by a user), the pour axis may be substantially perpendicular to a plane bisecting the handle 16 or the narrow cross-section of the container (such that the bottle bisecting plane is coplanar with the vertical plane V). Alternatively, depending on the user's pouring methods, the pour axis may be angled or skewed from perpendicular to the bottle bisecting plane.

Figure 1:
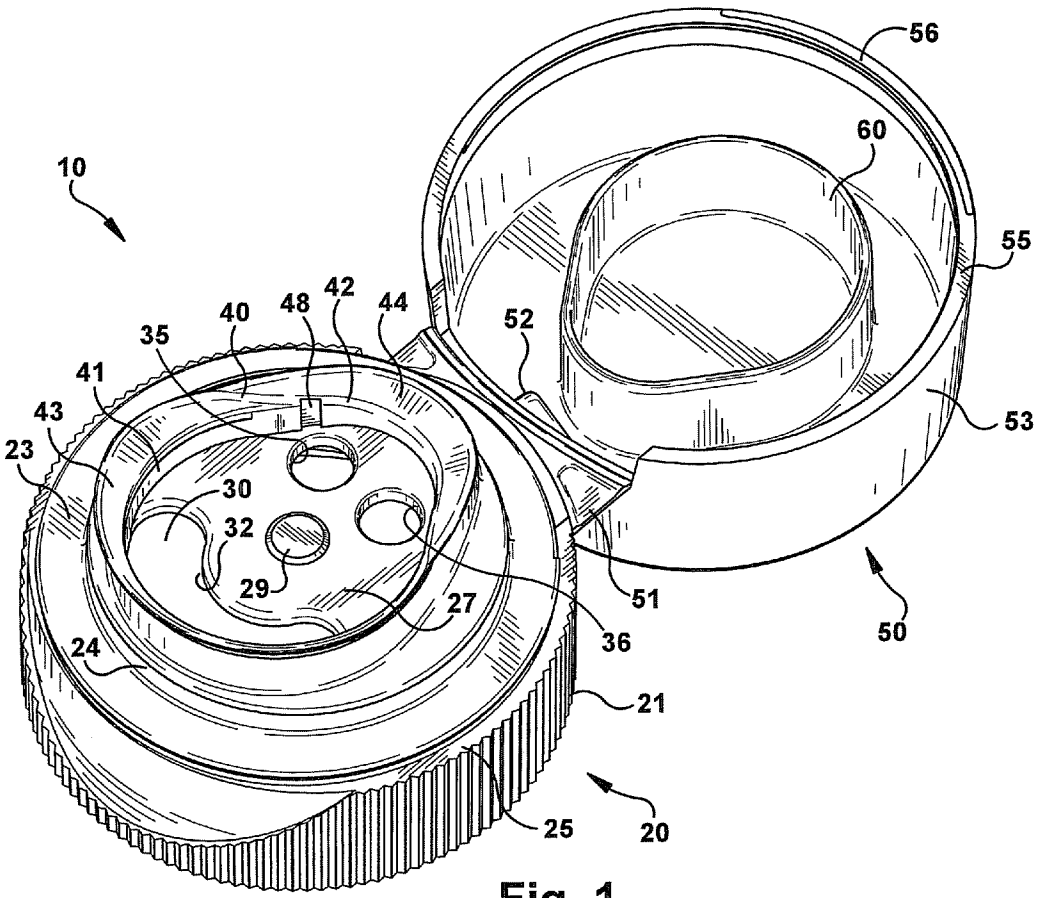
FIG. 1 is an upper perspective view of an exemplary dispensing closure, shown in an open position.
Figure 2:
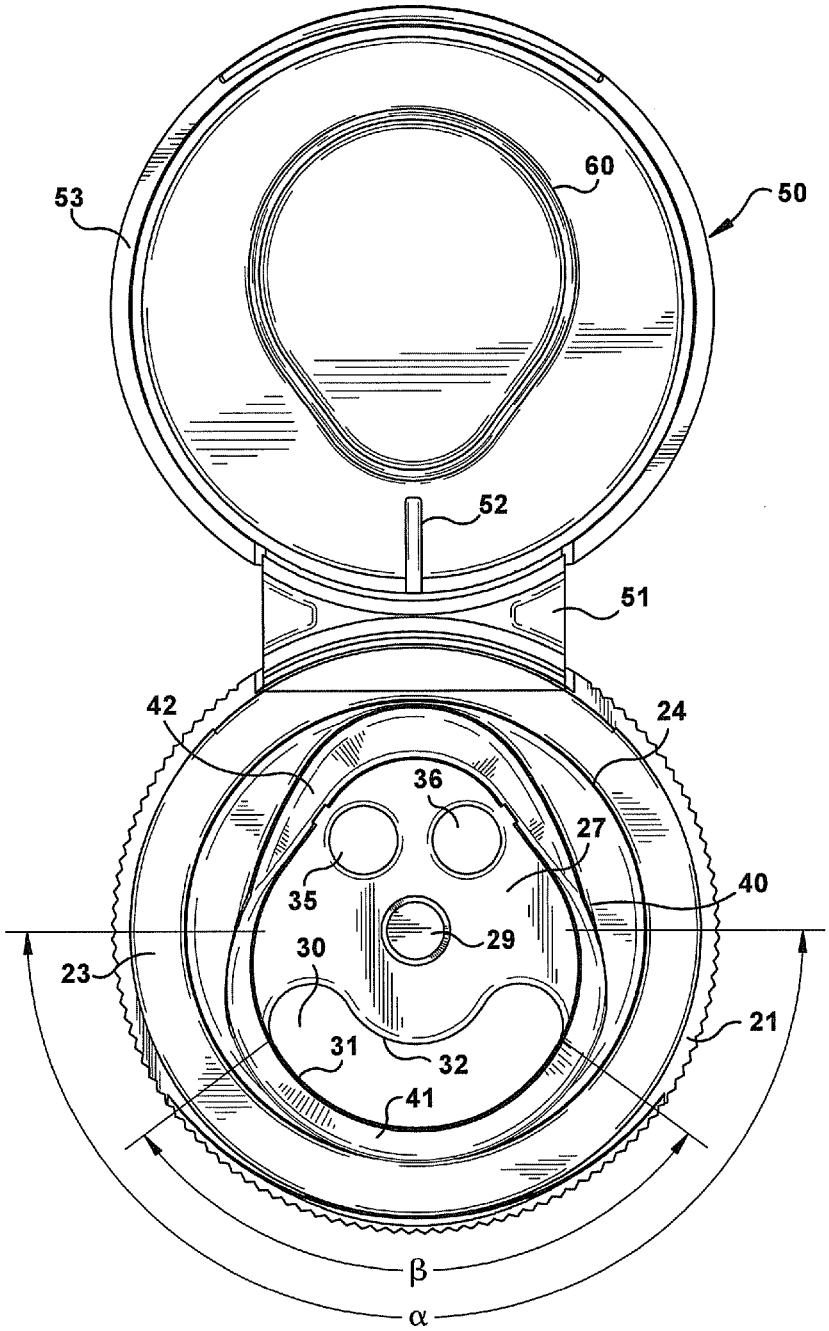
FIG. 2 is a top plan view of the dispensing closure of FIG. 1.
Figure 5:
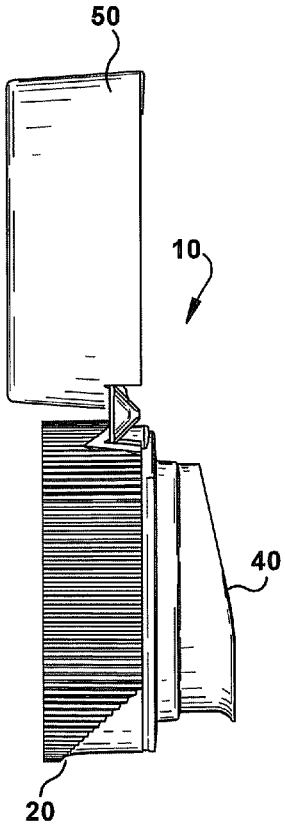
FIG. 5 is a left side elevational view of the dispensing closure of FIG. 1.
Figure 6:
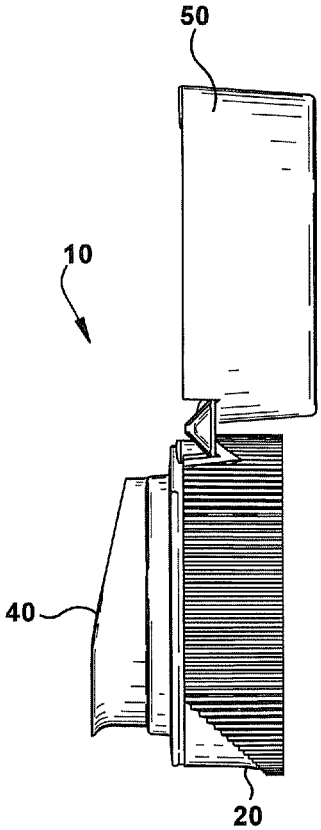
FIG. 6 is a right side elevational view of the dispensing closure of FIG. 1.
Figure 4:
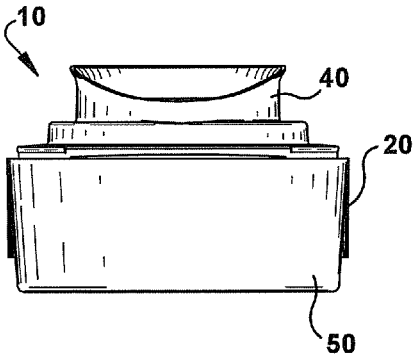
FIG. 4 is a rear elevational view of the dispensing closure of FIG. 1.
Figure 3:
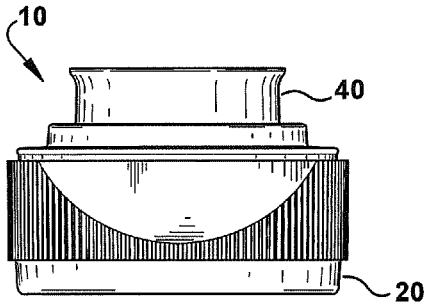
FIG. 3 is a front elevational view of the dispensing closure of FIG. 1.

Many features may be provided to accommodate this off-center orientation. As one example, a front portion of the spout may be provided with an outwardly contoured lip on an extended perimeter of the spout, which may reduce dripping of the dispensed fluid onto the central deck of the dispensing cap when pouring with the dispensing aperture cocked or rotated at an angle. In the illustrated embodiment, the front portion 41 of the spout 40 is provided with an outward contoured lip 43. While the size of the lip may vary, in one embodiment, the lip 43 extends over a perimeter of the front portion having an angle greater than 90°. In another embodiment, the lip 43 may extend over a perimeter or circumference having an angle greater than the dispensing aperture perimeter angle β, or an angle of a front edge arc of the dispensing aperture (e.g., greater than approximately 100°). In still another embodiment, the lip 43 may extend over a perimeter or circumference having an angle greater than the dispensing aperture included angle δ, formed by lines intersecting the rotationally outermost edges of the dispensing aperture 30 and a center point of the front edge arc (e.g., greater than approximately 120°). In the illustrated embodiment, as shown in FIG. 2, the lip 43 extends over a perimeter of the spout front portion having an angle α of greater than 120° (e.g., an angle between 120° and 180°, or an angle of approximately 160°).

As another example, a dispensing aperture may be provided with an extended arcuate front edge, such that a vertical plane intersects a portion of the arcuate dispensing aperture when the dispensing aperture is cocked or rotated at an angle with respect to the vertical plane (e.g., when the dispensing closure is rotationally "off-center" on the container). In one embodiment, the arcuate front edge of the dispensing closure is sized such that pouring of the contained fluid is substantially unaffected by a rotationally off-center position (e.g., an angle θ of up to 15°, 30°, or 45°) of a lateral centerline L of the aperture 30 with respect to the vertical plane V perpendicular to the pour axis. In the illustrated embodiment, a front edge 31 of the dispensing aperture 30 extends over a perimeter angle of approximately 100° (see FIG. 2). While a dispensing aperture having an arcuate front edge may be any suitable overall shape, such as, for example, circular or elliptical, in one embodiment, the dispensing aperture has a flattened or inward (i.e., extending toward the front edge) rear edge, such that the size of the dispensing aperture is reduced (and the amount of deck material within the spout is increased), for example, to prevent excessive pouring of the contained fluid. In the illustrated example, the dispensing aperture 30 includes a rear or inner edge 32 substantially parallel to the arcuate front or outer edge, forming a "C" or "smile" shaped aperture. In one such embodiment, the dispensing aperture 30 may be sized and shaped to limit unpressurized flow of a pancake syrup product to less than 5 ml/sec (e.g., approximately 3.5 ml/sec) at room temperature (viscosity of 500-1400 Brookfield) and less than 20 ml/sec (e.g., approximately 15.7 ml/sec) when heated (viscosity of 140-400 Brookfield at approximately 140° F.). This limited flow may be maintained as a consistent stream using the vent aperture configurations described herein. In another embodiment, as shown in FIG. 12, a dispensing aperture 30*a* having an arcuate front or outer edge 31*a* may be provided with a straight or flattened rear or inner edge 31*a*, forming a "D" shaped or semicircular aperture (or a different section of a circle or an ellipse), which would also reduce the dispensing aperture size (for example, as compared to a circular aperture) while maintaining an extended front arcuate edge.

As still another example, the multiple vent apertures 35, 36 of the closure 10 may be positioned such that when a lateral centerline L of the dispensing aperture 30 is cocked or rotated at an angle θ (e.g., an angle of approximately 15°, 30°, or 45°) with respect to the vertical plane V perpendicular to the pour axis (see FIG. 9B) and the container 15 is substantially tilted for pouring (i.e., tilted about the pour axis), at least one of the vent apertures 35, 36 remains substantially open to the air headspace (i.e., above the contained fluid F) of the container 15 during pouring. In one such embodiment, a vent aperture 35 is positioned substantially entirely outward (i.e., opposite the dispensing aperture 30) of a horizontal line H tangent a rotationally outermost edge 34 of the dispensing aperture 30. In such an embodiment, when the closure 10 is rotationally off-center at angle θ and the container 15 is tilted such that the contained fluid F extends to the uppermost edge of the dispensing aperture 30 (and to substantially block the second vent aperture 36), the first vent aperture 35 remains unobstructed. In the illustrated embodiment, two opposed vent apertures 35, 36 are positioned proximate to the rear portion 42 of the spout and proximate to the hinge 51 for air intake during pouring.

In the embodiment of FIGS. 1-9B, as shown in FIG. 9A, radial tangent lines T1 and T2 of outer edges of the dispensing aperture 30 extend outward of radial tangent lines T3 and T4 of outer edges of the vent apertures 35, 36 (with the tangent lines intersecting the front edge arc center point), such that a dispensing aperture included angle δ, as defined above, is greater than a vent aperture included angle γ. This arrangement may position the vent apertures 35, 36 a sufficient distance from the dispensing aperture to provide sufficient venting during pouring. In another embodiment, as shown in FIGS. 9C and 9D, the dispensing aperture 30' and vent apertures 35', 36' may be sized and positioned such that radial tangent lines T1' and T2' of outer edges of the dispensing aperture 30' are also substantially tangent to outer edges of the vent apertures 35', 36', such that the dispensing aperture included angle δ' is approximately equal to the vent aperture included angle γ (e.g., with both angles being approximately 100°). When the closure 10' is rotationally off-center at an angle θ' and the container 15' is tilted such that the contained fluid F extends to the uppermost edge of the dispensing aperture 30' (which may, but need not, coincide with tangent line T1'), both vent apertures 35', 36' remain unobstructed. In other embodiments, the ratio of the dispensing aperture included angle to the vent aperture included angle may range from approximately 0.8 to 1.5, from approximately 1.0 to 1.3, or from approximately 1.1 to 1.25.

According to another inventive aspect of the present application, the dispensing aperture and vent apertures may be shaped and positioned to present an ornamental or visually appealing pattern. As one example, as shown in the illustrated embodiment of FIGS. 1-8, the vent apertures 35 and dispensing aperture 30 may be shaped and positioned to form the eyes and mouth, respectively, of a "smiley face." To further contribute to the desired pattern or likeness, one or more features may be marked, molded, or otherwise formed on the central deck portion 27. As one example, as shown, a nub 29 may be positioned to present the likeness of a nose on the "smiley face" pattern. Other ornamental or pictorial patterns may additionally or alternatively be utilized.

While the dispensing closure may be provided in many different materials, in one embodiment, a dispensing closure is provided in an injection molded plastic, such as, for example, polypropylene. One of ordinary skill in the art would know how to mold the dispensing closures described herein based on the disclosure and using conventional molding techniques.

In other embodiments, inventive dispensing closures, as described herein, may include one or more of the above inventive features in combination with additional inventive elements. For example, in one embodiment, a dispensing closure may be provided with a separate, detached cap for added functionality. For example, in the exemplary dispensing enclosure 110 of FIG. 13, a cap 150 is separate from the dispensing closure body portion 120, such that the cap 150 may be removed, for example, for use as a serving bowl for heating or dispensing a controlled amount of fluid. The body 120 includes a skirt portion 121 that may, but need not be, configured for threaded assembly with the container 115. The cap 150 may be configured for snap-fit engagement with the body 120 to cover the dispensing aperture 130 and vent apertures 135, 136 disposed in a deck portion 123 radially inward of the spout 140 and skirt portion 121. The apertures 130, 135, 136 may, but need not, be consistent in shape, size, location, and orientation as the apertures 30, 35, 36 of the dispensing closure 10 as shown in FIGS. 1-9B and described above, for example, to accommodate an off-center orientation of the dispensing aperture 130. The cap 150 may, but need not, be provided with a projection (not shown) that fits into the spout 140 to provide a fluid tight seal in the cap's closed position.

In another embodiment, a dispensing closure may be adapted for consistent orientation on the container bottle, for example, to eliminate or reduce any off-center condition of the dispensing aperture during pouring. In the exemplary embodiment of FIG. 14, the dispensing closure 210 is oblong or oval shaped in horizontal cross-section to correspond to an oblong open end of the container bottle 215, and includes a skirt portion 221 configured for a snap-fit (i.e., non-threaded) attachment to the container bottle 215. While this attachment may substantially prevent the dispensing aperture 230 from being angled with respect to a bottle bisecting plane (perpendicular to the conventional pouring axis), the spout 240 and apertures 230, 235, 236 (disposed in the deck portion 223 radially inward of the spout 240) may still be configured (for example, as described above) to accommodate an off-center orientation of the dispensing aperture 230 resulting from a skewed pouring axis. For example, the apertures 230, 235, 236 may, but need not, be consistent in shape, size, location, and orientation as the apertures 30, 35, 36 of the dispensing closure 10 shown in FIGS. 1-9B and described above. The hinged cap 250 includes a projection 260 that fits into the spout 240 to provide a fluid tight seal in the cap's closed position.

In still another embodiment, a dispensing closure may be formed with an integral handle, thereby aligning the dispensing aperture with a handle-bisecting vertical plane that is perpendicular to the conventional pouring axis. In the exemplary embodiment of FIG. 15, the dispenser body 320 is oblong or oval shaped in horizontal cross-section to correspond to an oblong open end of the container bottle 315, and includes a skirt portion 321 configured for a snap-fit (i.e., non-threaded) attachment to the container bottle 315. Further, the body 320 is provided with an integral handle portion 328 extending from the outer skirt 321. As shown, the handle portion 321 may be oriented such that a handle bisecting plane also bisects the dispensing aperture 330. While this arrangement prevents the dispensing aperture 330 from being angled with respect to the handle bisecting plane (perpendicular to the conventional pouring axis), the spout 340, dispensing aperture 330, and vent apertures 335, 336 may still be configured (for example, as described above) to accommodate an off-center orientation of the dispensing aperture 330 resulting from a skewed pouring axis. For example, the apertures 330, 335, 336 may, but need not, be consistent in shape, size, location, and orientation as the apertures 30, 35, 36 of the dispensing closure 10 shown in FIGS. 1-9B and described above.

As shown, the outer skirt portion 321 of the dispensing closure 310 extends above the central deck 323 (in which the apertures 330, 335, 336 are disposed), forming an upper edge with the spout 340, such that the skirt 321 and spout 340 form an outer wall from which the deck 323 is recessed, radially inward of the skirt 321 and spout 340. This configuration eliminates any portion of a deck outward of the spout 340, which may help to prevent the buildup of fluid residue around the spout 340. The spout 340 is configured to form a well, which may be contoured to retain any undispensed residual fluid and to drain this fluid back into the container 315

While many different types of caps may be utilized, in the illustrated embodiment, the cap 350 is sized and shaped to be closely received within the spout 340, such that the outer perimeter of the cap 350 provides a fluid tight seal with the spout 340. As shown, the cap 350 may be provided with a hinged attachment aligned with the handle portion 328. A button element 338 disposed on the handle 328 is configured to pivot the cap 350 from a closed position to an open position when depressed by the user (e.g., by engaging the cap 350 below a hinge point on the cap to pivot the cap upward).

Still other variations may be made to the exemplary embodiments described herein. For example, a dispensing closure may be provided without a spout portion, without a cap, or without any vent apertures.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated. Also, the various features of the dispensing closures discussed above and claimed below may be considered to be separate building blocks which may provide utility in and of themselves. Thus, it is contemplated that inventive devices and arrangements may be designed based on the teachings herein using virtually any combination or permutation of any one or more of these separate features without necessarily some or all of the other features. Accordingly, it is contemplated that arrangements, devices, and combinations of devices may be claimed using virtually any combination or permutation of any one or more of these features.

The invention claimed is:

1. A closure comprising a body having an outer skirt configured to be assembled with a container, a deck extending radially inward of the skirt, a spout extending from the deck in a direction opposite the skirt, the spout surrounding a central portion of the deck and having a teardrop shape, wherein the central portion of the deck defines at least a first aperture having a front edge substantially flush with a front portion of the spout and a rear edge radially spaced from a rear portion of the spout by a portion of the deck, wherein at least a portion of the front portion and the rear portion of the spout are angled perpendicular with respect to the deck, and a cap movable between a closed position and an open position, the cap including a flange extending from an inner surface of the cap, the flange being sized to be received within the spout when the cap is in the closed position, wherein the flange includes a radially outer surface that forms a liquid tight seal with a radially inner surface of the spout, and the inner surface of the spout further comprises at least one groove configured to define a passage between the flange and the spout when the cap is in the closed position.

2. The closure of claim 1, wherein the front portion of the spout is arcuate and has a first radius, and the rear portion of the spout is arcuate and has a second radius smaller than the first radius.

3. The closure of claim 1, wherein the front portion of the spout includes an outwardly contoured lip.

4. The closure of claim 3, wherein the lip extends around a circumference of between 120° and 180° of the front portion of the spout.

5. The closure of claim 1, wherein the rear portion of the spout includes an outwardly inclined upper surface.

6. The closure of claim 1, wherein a wall thickness of the rear portion of the spout is greater than a wall thickness of the front portion of the spout.

7. The closure of claim 1, wherein the cap is hingedly connected to the body distal to the first aperture.

8. The closure of claim 1, wherein the first aperture comprises parallel front and rear arcuate edges, forming a substantially C-shaped aperture.

9. The closure of claim 1, wherein the central portion of the deck further defines a second aperture proximate the rear portion of the spout.

10. The closure claim 9, wherein the central portion of the deck defines a third aperture proximate the second aperture and distal to the first aperture, wherein each of the first aperture, second aperture, and third aperture are coplanar.

11. A closure comprising:

a body having an outer skirt configured to be assembled with a container and a deck extending radially inward of the skirt, the deck defining a first aperture and second and third apertures spaced apart from the first aperture, wherein a liquid is dispensable through the first aperture, and the second and third apertures each being substantially smaller than the first aperture;

a spout extending from the deck in a direction opposite the skirt, wherein the spout has a teardrop shape; and a cap moveable between a closed position covering the first, second, and third apertures and an open position uncovering the first, second, and third apertures the cap including a flange extending from an inner surface of the cap, the flange being sized to be received within the spout when the cap is in the closed position, wherein the flange includes a radially outer surface that forms a liquid tight seal with a radially inner surface of the spout, and the inner surface of the spout further comprises at least one groove configured to define a passage between the flange and the spout when the cap is in the closed position.

12. The closure of claim 11, wherein the first aperture comprises parallel inner and outer arcuate edges.

13. The closure of claim 11, wherein the front edge of the first aperture forms an arc, and the second and third apertures are positioned substantially entirely outward of a line intersecting a center point of the arc and a rotationally outermost edge of the first aperture.

14. The closure of claim 11, wherein the front edge of the first aperture forms an arc having a center point, and rotationally outermost edges of the second and third apertures form an included angle with the arc center point, the included angle being less than the angle of the arc.

15. The closure of claim 11, further comprising a spout extending from the deck radially inward of the skirt and in a direction opposite the skirt, the spout surrounding the first, second, and third apertures.

16. The closure of claim 15, wherein the first aperture and the spout are configured such that when the closure is assembled with a container, pouring of a contained liquid from the container is substantially unaffected by a rotationally off-center position of a lateral centerline of the aperture of approximately 45° with respect to a vertical plane substantially perpendicular to a pouring axis of the container.

17. A closure comprising:

a body having an outer skirt configured to be assembled with a container, a deck extending radially inward of the skirt, and a spout extending from the deck at an angle from perpendicular to the deck and in a direction opposite the skirt, the spout surrounding a central portion of the deck and having a teardrop shape, wherein the central portion of the deck defines a first aperture having a front edge substantially flush with a front portion of the spout and a rear edge radially spaced from the rear portion of the spout by a portion of the deck, wherein a liquid is dispensable through the first aperture, and second and third apertures spaced apart from the first aperture and proximate the rear portion of the spout, the second and third apertures each being substantially smaller than the first aperture; and a cap moveable between a closed position covering the first, second, and third apertures and an open position uncovering the first, second, and third apertures; wherein the front edge of the first aperture forms an arc having a center point, and rotationally outermost edges of the second and third apertures form an included angle with the arc center point, with the included angle being no greater than the angle of the arc, the cap including a flange extending from an inner surface of the cap, the flange being sized to be received within the spout when the cap is in the closed position, wherein the flange includes a radially outer surface that forms a liquid tight seal with a radially inner surface of the spout, and the inner surface of the spout further comprises at least one groove configured to define a passage between the flange and the spout when the cap is in the closed position.

18. The closure of claim 17, wherein the angle of the arc is greater than 90°.

19. The closure of claim 17, wherein the included angle of the second and third apertures is greater than 90°.

20. The closure of claim 17, wherein rotationally outermost edges of the first aperture form an included angle with the arc center point of at least 120°.

21. The closure of claim 17, wherein the cap is hingedly connected to the body distal to the first aperture.

22. The closure of claim 17, wherein the first aperture is sized and shaped to limit unpressurized flow of a liquid having a viscosity of 500 Brookfield to less than 5 ml/sec.

23. The closure of claim 17, wherein the first aperture is sized and shaped to limit unpressurized flow of a liquid having a viscosity of 140 Brookfield to less than 20 ml/sec. (e.g., approximately 3.5 ml/sec.

24. The closure of claim 17, wherein the first aperture and the spout are configured such that when the closure is assembled with a container, pouring of a contained liquid from the container is substantially unaffected by a rotationally off-center position of a lateral centerline of the aperture of approximately 30° with respect to a vertical plane substantially perpendicular to a pouring axis of the container.

25. The closure of claim 17, wherein the first aperture and the spout are configured such that when the closure is assembled with a container, pouring of a contained liquid from the container is substantially unaffected by a rotationally off-center position of a lateral centerline of the aperture of approximately 45° with respect to a vertical plane substantially perpendicular to a pouring axis of the container.

26. The closure of claim 17, wherein the first, second, and third apertures account for less than half of a total radially extending area within the spout.

27. The closure of claim 17, wherein the first, second, and third apertures account for between 25% and 50% of a total radially extending area within the spout.

* * * * *